US010505265B2

(12) United States Patent
Ke et al.

(10) Patent No.: US 10,505,265 B2
(45) Date of Patent: Dec. 10, 2019

(54) ANTENNA ADJUSTMENT SYSTEM AND BASE STATION

(71) Applicant: Huawei Technologies Co., Ltd., Shenzhen (CN)

(72) Inventors: Youhe Ke, Shenzhen (CN); Dongli Wang, Shenzhen (CN); Hongdian Du, Shenzhen (CN); Jun Wu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/047,636

(22) Filed: Jul. 27, 2018

(65) Prior Publication Data

US 2018/0358689 A1 Dec. 13, 2018

Related U.S. Application Data

(63) Continuation of application No. PCT/CN2017/071867, filed on Jan. 20, 2017.

(30) Foreign Application Priority Data

Jan. 28, 2016 (CN) ..... 2016 1 0061651

(51) Int. Cl.
*H01Q 1/12* (2006.01)
*H01Q 3/02* (2006.01)
(Continued)

(52) U.S. Cl.
CPC ..... *H01Q 1/246* (2013.01); *H01Q 1/1242* (2013.01); *H01Q 1/185* (2013.01)

(58) Field of Classification Search
CPC ..... H01Q 1/1242; H01Q 1/12; H01Q 1/1257; H01Q 1/18; H01Q 1/185; H01Q 1/24;
(Continued)

(56) References Cited

U.S. PATENT DOCUMENTS 2,945,229 A * 7/1960 Klauser ..... H01Q 3/16 343/754
5,359,337 A * 10/1994 Eguchi ..... H01Q 1/18 343/765
(Continued)

FOREIGN PATENT DOCUMENTS

CN 101877429 A 11/2010
CN 201956460 U 8/2011
(Continued)

OTHER PUBLICATIONS

Machine Translation and Abstract of Chinese Publication No. CN103138050, Jun. 5, 2013, 10 pages.
(Continued)

*Primary Examiner* — Tho G Phan
(74) *Attorney, Agent, or Firm* — Conley Rose, P.C.

(57) ABSTRACT

An antenna adjustment system and a base station, where the antenna adjustment system includes an inertial feedback unit configured to detect a swing angle of an antenna when the antenna swings with a housing, and send an angle signal to a controller, an actuator and an elastic element configured to control an auxiliary board to rotate back in a direction opposite to a swing direction of the housing in order to counteract deflection caused by swing of the housing of the antenna fastened to the auxiliary board. The actuator is driven by the controller based on the angle signal. Therefore, a position of an antenna can be adjusted with swing of the antenna such that signal sending stability of the antenna can be ensured.

20 Claims, 6 Drawing Sheets

(51) Int. Cl.
*H01Q 1/24* (2006.01)
*H01Q 1/18* (2006.01)

(58) Field of Classification Search
CPC ..... H01Q 1/246; H01Q 3/02; H01Q 3/20; H01Q 15/16; H01Q 19/13
See application file for complete search history.

(56) References Cited

U.S. PATENT DOCUMENTS

| | | | | |
|---|---|---|---|---|
| 5,469,182 | A * | 11/1995 | Chaffee | H01Q 1/125 248/183.4 |
| 7,518,569 | B1 * | 4/2009 | Conrad | H01Q 1/08 343/713 |
| 8,890,756 | B2 * | 11/2014 | Tsai | H01Q 3/02 343/757 |
| 9,954,277 | B2 * | 4/2018 | Fukuda | H01Q 1/18 |
| 2008/0303730 | A1 | 12/2008 | Kyhle | |
| 2010/0271274 | A1 | 10/2010 | Gibson et al. | |
| 2014/0009631 | A1 | 1/2014 | Topliss | |
| 2014/0125825 | A1 | 5/2014 | Baer et al. | |
| 2015/0195439 | A1 | 7/2015 | Miller et al. | |
| 2015/0212336 | A1 | 7/2015 | Hubert et al. | |
| 2016/0352009 | A1 | 12/2016 | Tanaka | |
| 2018/0131072 | A1 * | 5/2018 | Hataya | H01Q 3/08 |

FOREIGN PATENT DOCUMENTS

| | | | |
|---|---|---|---|
| CN | 103138050 | A | 6/2013 |
| CN | 105742781 | A | 7/2016 |
| JP | 2007129624 | A | 5/2007 |
| WO | 2015122142 | A1 | 8/2015 |

OTHER PUBLICATIONS

Machine Translation and Abstract of Chinese Publication No. CN105742781, Jul. 6, 2016, 20 pages.
Machine Translation and Abstract of Chinese Publication No. CN201956460, Aug. 31, 2011, 16 pages.
Machine Translation and Abstract of Japanese Publication No. JP2007129624, May 24, 2007, 8 pages.
Foreign Communication From a Counterpart Application, PCT Application No. PCT/CN2017/071867, English Translation of International Search Report dated Mar. 29, 2017, 2 pages.
Foreign Communication From a Counterpart Application, PCT Application No. PCT/CN2017/071867, English Translation of Written Opinion dated Mar. 29, 2017, 7 pages.

* cited by examiner

ANTENNA ADJUSTMENT SYSTEM AND BASE STATION

CROSS-REFERENCE TO RELATED APPLICATIONS

This application is a continuation of International Patent Application No. PCT/CN2017/071867 filed on Jan. 20, 2017, which claims priority to Chinese Patent Application No. 201610061651.0 filed on Jan. 28, 2016. Both of the aforementioned applications are hereby incorporated by reference in their entireties.

TECHNICAL FIELD

The present disclosure relates to the field of communications technologies, and in particular, to a base station to be installed on a street lamp pole and an antenna adjustment system inside the base station.

BACKGROUND

Popularization of intelligent terminals and abundance of mobile broadband services are accompanied by a constant and rapid traffic increase of future mobile networks. To resolve this problem, an operator needs to increase a network capacity by obtaining more spectrum resources, improving spectral efficiency, increasing cell density, or the like. A base station with a small volume, low power, and flexible deployment is a mainstream choice for improving the cell density in the future, and some small-sized base stations are mainly installed on an exterior wall of a building or on a street lamp pole in order to better meet a mobile broadband data service requirement of a user in a hotspot area.

In addition, because a main deployment scenario of a base station is a street lamp pole, the street lamp pole suffers from load such as wind load fluctuation, and vibration and impact caused when a heavy vehicle passes by, and the load inevitably causes swing of the lamp pole. Currently, there is no uniform standard or requirement for a swing angle in the industry due to a difference in existing lamp pole materials, technologies, and installation. For example, an allowed maximum deflection displacement for a street lamp pole in the United Kingdom is 5%, and a maximum deflection displacement allowed by common national manufacturers is 2.5% to 5% (mainly out of consideration of material yield strength and non-linearity of the lamp pole). It can be learned through measurement that a maximum swing angle of an existing lamp pole is far greater than a microwave half-power angle. Consequently, a backhaul signal of an antenna adjustment system in the base station is interrupted, and signal transmission quality is severely affected. Therefore, lamp pole swing caused by the vehicle and the wind load severely affects microwave backhaul deployment of the base station, and an antenna adjustment system in which an antenna transmit direction can be adjusted with swing of a lamp pole is in an urgent need to ensure signal stability.

SUMMARY

The present disclosure provides an antenna adjustment system and a base station that adjust a position of an antenna when the position of the antenna is deflected or swings with an antenna housing. The antenna adjustment system and the base station help ensure signal sending stability of an antenna.

To achieve the foregoing objective, implementations of the present disclosure provide the following technical solutions.

According to an aspect, an implementation of the present disclosure provides an antenna adjustment system, including a housing, an auxiliary board, an antenna fastened to the auxiliary board, an inertial feedback unit fastened to the auxiliary board, a controller, an actuator, and an elastic element, where the auxiliary board is rotatably connected to the housing, and a rotation center is formed at a position at which the auxiliary board and the housing are rotatably connected, the actuator and the elastic element are each connected between the housing and the auxiliary board, the inertial feedback unit is configured to detect a deflection angle of the antenna when the antenna swings with the housing, and send an angle signal to the controller, the controller is configured to receive and process the angle signal, the actuator and the elastic element are configured to control the auxiliary board to rotate back in a direction opposite to a swing direction of the housing in order to counteract deflection, caused by swing of the housing, of the antenna fastened to the auxiliary board, and the actuator is driven by the controller based on the angle signal.

The antenna adjustment system in the present disclosure is applied to a small-sized base station, and the base station is fastened to a street lamp pole. When the lamp pole swings, the entire base station swings. In the present disclosure, the auxiliary board is rotatably connected to the housing, and when the housing swings, the antenna swings with the housing. The inertial feedback unit detects the swing angle of the antenna, and the controller drives the actuator based on the angle signal transferred by the inertial feedback unit, and further drives the antenna to rotate back, to counteract swing of the antenna such that the antenna keeps in an initial position. In this way, the antenna adjustment system in the present disclosure can avoid signal interruption caused by shaking of the antenna, and can ensure signal receiving and sending stability of the antenna and signal transmission quality. To ensure smoothness of swing of the antenna, the elastic element is elastically connected between the housing and the auxiliary board, to counterbalance driving force of the actuator such that the antenna bears balanced force, and moves smoothly.

In an implementation, the controller is fastened to the housing, and certainly the controller may alternatively be fastened to the auxiliary board. When the controller is fastened to the housing, weight borne by the auxiliary board can be reduced.

With reference to the first aspect, in a first possible implementation of the first aspect of the present disclosure, the auxiliary board and the housing are rotatably connected using a bearing, and elastic force of the elastic element is greater than damping force of the bearing. In this implementation, a design manner in which the elastic force of the elastic element is greater than the damping force of the bearing is used in order to help reduce costs of the antenna adjustment system. When the elastic force of the elastic element is greater than the damping force of the bearing, obstruction caused by the damping force of the bearing on position adjustment for the antenna is reduced. Compared with other approaches in which the damping force of the bearing is reduced by improving machining precision and pre-fastening the bearing, this implementation has low costs and is easy to implement.

With reference to the first possible implementation of the first aspect, in a second possible implementation, inertial force of the auxiliary board for rotating relative to the housing is less than the elastic force of the elastic element. When the inertial force is less than the elastic force of the elastic element, output power of the actuator can be reduced. This is because the driving force of the actuator is in direct proportion to the elastic force of the elastic element and when the inertial force is relatively small, relatively small output power of the actuator is required to adjust a position of the antenna. Therefore, the implementation can save energy.

With reference to the second possible implementation of the first aspect, in a third possible implementation, the auxiliary board and elements fastened to the auxiliary board jointly form a rotation component, and a gravity position of the rotation component overlaps the position of the rotation center, or a distance between a gravity position of the rotation component and the position of the rotation center is less than a shortest distance between the gravity position of the rotation component and an edge of the auxiliary board. An optimal implementation is that the gravity position overlaps the rotation center. In such setting that the gravity position is close to the rotation center, the output power of driving of the actuator can be further reduced. In addition, space utilization is improved, thereby helping a miniaturization design of the antenna adjustment system.

Further, the rotation center is located at a central position of the auxiliary board. For example, if the auxiliary board is a circular board, the rotation center is at a circle center of the auxiliary board. Certainly, the auxiliary board may be in another shape, such as a square or a regular polygon. In a preferred design, the auxiliary board has a centrosymmetric structure.

Further, the antenna is fastened to one side of the auxiliary board, the inertial feedback unit is fastened to the other side of the auxiliary board, and the elastic element and the actuator are each connected between the other side of the auxiliary board and the housing.

With reference to the first aspect, in a fourth possible implementation, the elastic element and the actuator are distributed on two sides of the rotation center. In a preferred design solution, the elastic element and the actuator are symmetrically distributed on the two sides of the rotation center. Due to the symmetrical distribution design, the elastic force of the elastic element can be directly equal to the driving force of the actuator. One end of the elastic element is fastened to the housing, and the other end of the elastic element is fastened to the auxiliary board. In a process in which the actuator drives the auxiliary board to rotate, the elastic element is configured to provide, for the auxiliary board, elastic force in a same direction as the driving force of the actuator.

In another implementation, the elastic element and the actuator are distributed on a same side of the rotation center, one end of the elastic element is fastened to the housing and the other end of the elastic element is fastened to the auxiliary board, and when the actuator drives the auxiliary board to rotate, the elastic element is configured to provide, for the auxiliary board through deformation, elastic force in a direction opposite to that of the driving force of the actuator.

With reference to the first aspect, in a fifth possible implementation, the actuator is a voice coil actuator, the actuator includes a base and a mover, the base is hingedly connected to the housing, the mover is hingedly connected to the auxiliary board, and the mover is configured to apply force to the auxiliary board when the housing is deflected such that the auxiliary board rotates around the rotation center in a direction opposite to a deflection direction of the housing. The voice coil actuator may be any one of a cylindrical voice coil actuator, an actuator that changes linear motion into rotational motion, and a circular (swing) voice coil actuator.

With reference to the first aspect, in a sixth possible implementation, the actuator is a torque motor, the actuator includes a mounting rack and a motor shaft, the mounting rack is fastened to the housing, the motor shaft is fastened to the auxiliary board, and the motor shaft is configured to apply force to the auxiliary board when the housing is deflected such that the auxiliary board rotates around the rotation center in a direction opposite to a deflection direction of the housing.

With reference to any one of the foregoing implementations of the first aspect, in a seventh possible implementation, the controller includes a first comparison unit, a second comparison unit, and a power driving unit, where the first comparison unit is configured to compare a first preset value with the swing angle of the antenna that is detected by the inertial feedback unit, and send a signal to the power driving unit when the swing angle is greater than or equal to the first preset value, the power driving unit is configured to drive the actuator based on the received signal such that the actuator drives the antenna to rotate back, the second comparison unit is configured to compare a second preset value with a difference between the swing angle and a back-rotation angle, where the back-rotation angle is detected by the inertial feedback unit, and the second comparison unit sends a signal to the power driving unit when the difference between the swing angle and the back-rotation angle is less than the second preset value, and the power driving unit is further configured to stop driving the actuator based on the signal sent by the second comparison unit. The first preset value and the second preset value may be designed based on an antenna type or an antenna usage scenario. For example, in an implementation, the first preset value ranges from 0.1 degree to 0.2 degree.

With reference to the seventh implementation of the first aspect, in an eighth possible implementation, the second preset value ranges from 0.2 degree to 0.5 degree.

The elastic element is a linear spring or a rotary spring.

The inertial feedback unit includes a gyroscope and an accelerometer. An angular velocity at which the antenna swings is collected using the gyroscope, the swing angle of the antenna is collected using the accelerometer, and the angular velocity collected by the gyroscope and the angle collected by the accelerometer are mutually corrected, to ensure precision of position control for the antenna.

According to a second aspect, the present disclosure further provides a base station, including the antenna adjustment system according to any implementation of the first aspect.

The base station and the antenna adjustment system provided in the present disclosure can adjust the position of the antenna when the position of the antenna is deflected or swings with the housing of the antenna. When the antenna deviates from an initial installation position, the inertial feedback unit detects a status of the antenna, and the controller drives the actuator, to further adjust the antenna such that the antenna moves relative to the housing, and returns to an initial installation angle. Therefore, when an external environment forces the base station to swing, the antenna adjustment system can adaptively adjust the position of the antenna (to be specific, constantly adjust the antenna in a process in which the antenna swings with the housing of the base station) in order to counteract swing of the antenna. Therefore, the antenna transfers a signal in a stable manner, and signal interruption caused by swing of the antenna is avoided.

BRIEF DESCRIPTION OF DRAWINGS

To describe the technical solutions in the present disclosure more clearly, the following briefly describes the accompanying drawings required for describing the implementations. The accompanying drawings in the following description show merely some implementations of the present disclosure, and a person of ordinary skill in the art may still derive other drawings from these accompanying drawings without creative efforts.

DESCRIPTION OF EMBODIMENTS

The following clearly describes the technical solutions in the implementations of the present disclosure with reference to the accompanying drawings in the implementations of the present disclosure.

The present disclosure relates to a base station and an antenna adjustment system disposed in the base station. The base station may be a small-sized base station, and is mainly installed on an exterior wall of a building or on an upper part of a street lamp pole in order to better meet a mobile broadband data service requirement of a user in a hotspot area. The base station is prone to swing due to impact from an external environment (such as wind force or vibration caused by a heavy vehicle). The antenna adjustment system in the present disclosure is configured to adjust a position of an antenna. When the entire base station swings, an antenna in the base station is rotated back using the antenna adjustment system to ensure an initial installation position of the antenna such that the antenna stably and reliably receives and sends signals.

Figure 1:
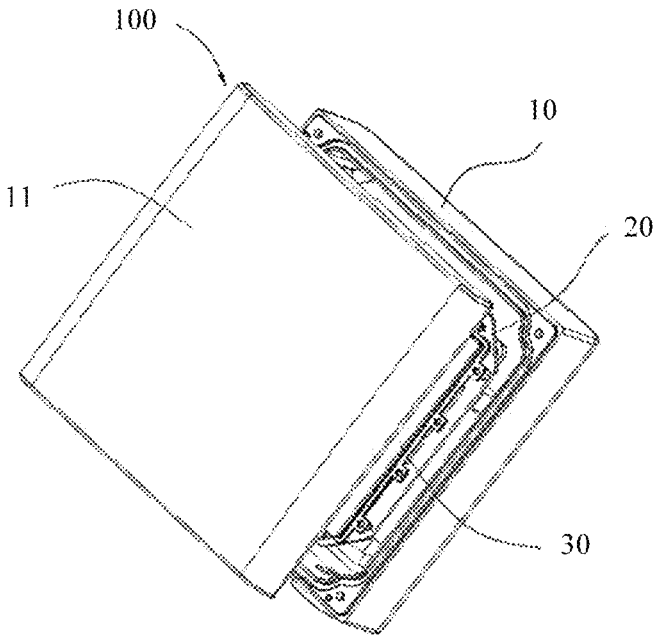
FIG. 1 is a schematic three-dimensional diagram of an antenna adjustment system in which a cover body is separated from a housing according to an implementation of the present disclosure.
Figure 2:
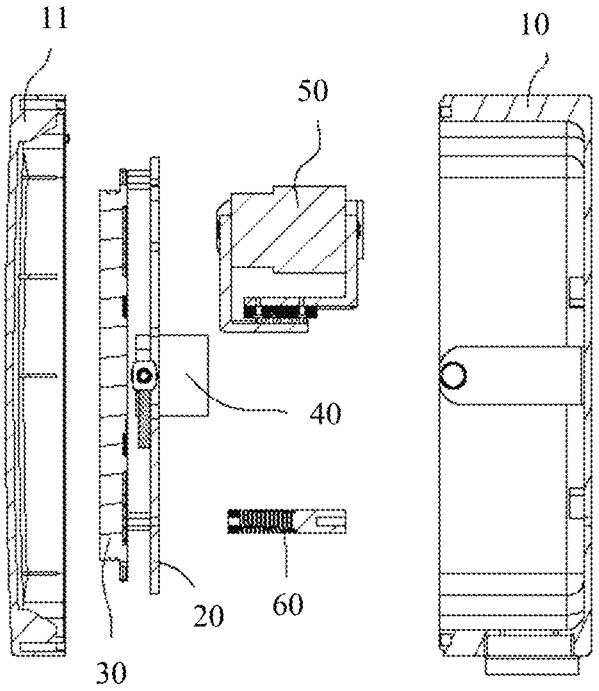
FIG. 2 is a schematic plane exploded view of an antenna adjustment system according to an implementation of the present disclosure.
Figure 4:
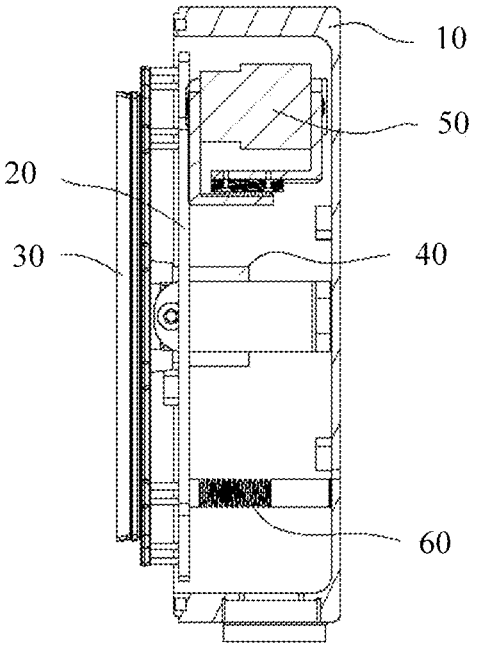
FIG. 4 is a schematic sectional view of an antenna adjustment system that includes no cover body according to an implementation of the present disclosure.

Referring to FIG. 1, FIG. 2, and FIG. 4, a base station 100 includes an antenna adjustment system. The antenna adjustment system includes a housing 10, an auxiliary board 20, an antenna 30, an inertial feedback unit 40 fastened to the auxiliary board 20, a controller (not shown), an actuator 50, and an elastic element 60. The housing 10 is a hollow housing structure with an opening. In this implementation, a cover body 11 shields the opening of the housing 10, the housing 10 and the cover body 11 cooperate with each other to jointly form enclosed space, and the auxiliary board 20, the antenna 30, the inertial feedback unit 40, the controller, the actuator 50, and the elastic element 60 are accommodated in the enclosed space. The controller is not shown in the figure. It may be understood that in an implementation, the controller is fastened to the housing 10. The controller may be disposed on a circuit board in the base station 100, and the circuit board may be fastened to an inner surface of the housing 10. The controller is fastened to the housing 10, to help reduce weight borne by the auxiliary board 20. Certainly, in another implementation, the controller may alternatively be fastened to the auxiliary board 20. The auxiliary board 20 is rotatably connected to the housing 10, and a rotation center is formed at a position at which the auxiliary board 20 and the housing 10 are rotatably connected. The actuator 50 and the elastic element 60 are each connected between the housing 10 and the auxiliary board 20. The actuator 50 is configured to provide driving force for the auxiliary board 20 to drive the auxiliary board 20 to swing. The elastic element 60 provides elastic force that counterbalances the driving force of the actuator 50. Under action of the driving force and the elastic force, the auxiliary board 20 is rotated smoothly. In other words, the elastic element 60 is configured to counterbalance the driving force of the actuator 50.

In an implementation, the actuator 50 and the elastic element 60 are distributed on two sides of the rotation center. In a preferred design, the auxiliary board 20 has a centrosymmetric structure. In a process in which the actuator 50 pushes the auxiliary board 20, the elastic element 60 is compressed, and the driving force of the actuator 50 and the elastic force of the elastic element 60 are in a same direction and have same magnitude. Because the driving force of the actuator 50 and the elastic force of the elastic element 60 are distributed on the two sides of the rotation center, the auxiliary board 20 can keep balance during swinging.

In another implementation, the actuator 50 and the elastic element 60 may alternatively be distributed on a same side of the rotation center. In a process in which the actuator 50 pushes the auxiliary board 20, the elastic element 60 is elongated, and the driving force of the actuator 50 and the elastic force of the elastic element 60 are in different directions and have same magnitude such that the auxiliary board 20 can keep balance during swinging.

The antenna 30 is fastened to the auxiliary board 20, and the inertial feedback unit 40 is also fastened to the auxiliary board 20. In a process in which the antenna 30 and the auxiliary board 20 rotate together, when the antenna 30 swings with the housing 10, the inertial feedback unit 40 can detect a swing angle of the antenna 30 and send an angle signal to the controller. The controller receives and processes the angle signal, and the controller drives the actuator 50 based on the angle signal such that the actuator 50 drives the antenna 30 to rotate back to counteract swing of the antenna 30. In other words, the actuator 50 and the elastic element 60 are configured to control the auxiliary board 20 to rotate back in a direction opposite to a swing direction of the housing 10 to counteract deflection, caused by swing of the housing 10, of the antenna 30 fastened to the auxiliary board 20. The actuator 50 is driven by the controller based on the angle signal. The inertial feedback unit 40 and the controller can be electrically connected using a cable, and the controller and the actuator 50 can also be electrically connected using a cable.

In the present disclosure, the auxiliary board 20 is rotatably connected to the housing 10. When the housing 10 swings, the antenna 30 swings with the housing 10, and the inertial feedback unit 40 detects the swing angle of the antenna 30. The controller drives the actuator 50 based on the angle signal transferred by the inertial feedback unit 40, and further drives the antenna 30 to rotate back, to counteract swing of the antenna 30 such that the antenna 30 keeps in an initial position. In this way, the antenna adjustment system in the present disclosure can avoid signal interruption caused by shaking of the antenna 30, and can ensure signal receiving and sending stability of the antenna 30 and signal transmission quality.

The auxiliary board 20 and the housing 10 are rotatably connected using a bearing, and the elastic force of the elastic element 60 is greater than damping force of the bearing. In an implementation, a method for calculating the damping force may be as follows. In a rotation process of the auxiliary board 20, the inertial feedback unit 40 detects an acceleration of a rotation component in the rotation process, and the damping force is calculated using the acceleration and weight. The elastic force of the elastic element 60 may be calculated using an elastic deformation amount and an elastic system, and the elastic deformation amount may be obtained using a displacement detected by the inertial feedback unit 40. In this implementation, a design manner in which the elastic force of the elastic element 60 is greater than the damping force of the bearing is used in order to help reduce costs of the antenna adjustment system. When the elastic force of the elastic element 60 is greater than the damping force of the bearing, obstruction caused by the damping force of the bearing on position adjustment for the antenna 30 is reduced. Compared with the other approaches in which the damping force of the bearing is reduced by improving machining precision and pre-fastening the bearing, this implementation has low costs and is easy to implement.

Figure 3:
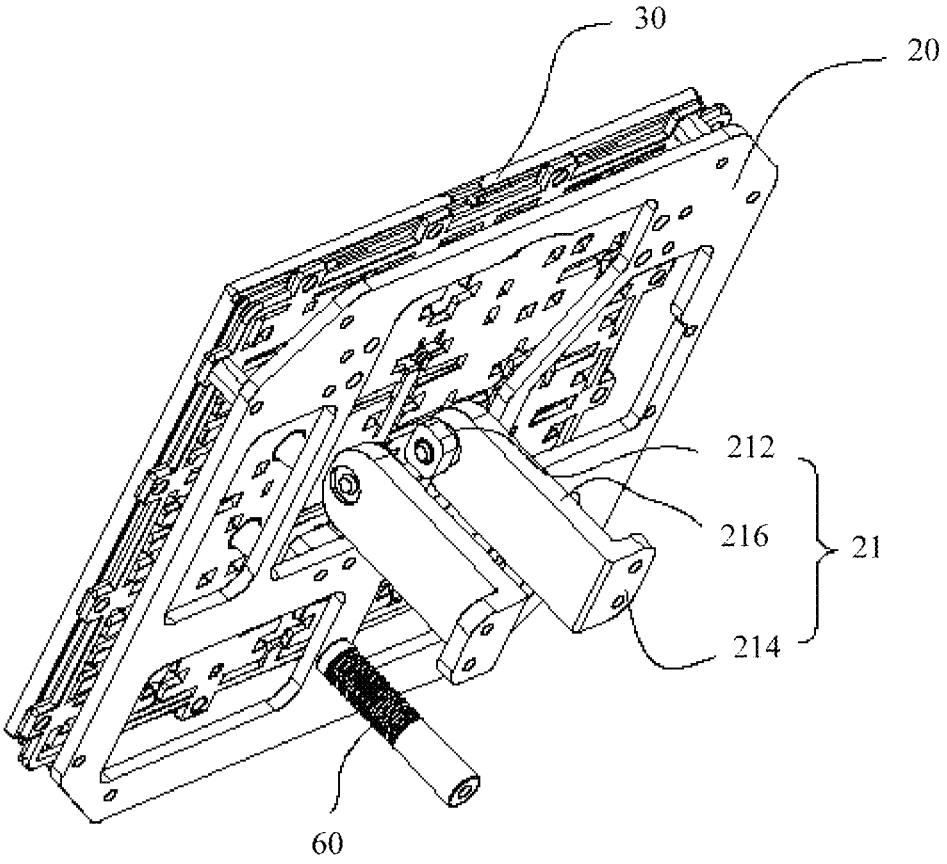
FIG. 3 is a schematic three-dimensional diagram of an antenna adjustment system in which an antenna and an elastic element are fastened to an auxiliary board according to an implementation of the present disclosure.

Referring to FIG. 3, the auxiliary board 20 and the housing 10 are connected using a connector 21. The connector 21 includes a hinged end 212, a fastening end 214, and a connection arm 216 connected between the two ends. A bearing is installed between the auxiliary board 20 and the hinged end 212 to implement a rotational connection between the auxiliary board 20 and the connector 21. The fastening end 214 of the connector 21 is fastened to the inner surface of the housing 10.

Inertial force of the auxiliary board 20 for rotating relative to the housing 10 is less than the elastic force of the elastic element 60. When the inertial force is less than the elastic force of the elastic element 60, output power of the actuator 50 can be reduced. This is because the driving force of the actuator 50 is in direct proportion to the elastic force of the elastic element 60 and when the inertial force is relatively small, relatively small output power of the actuator 50 is required to adjust a position of the antenna 30. Therefore, the implementation can save energy. For example, in an implementation, the elastic force of the elastic element 60 may be calculated using the elastic deformation amount and the elastic system, and the elastic deformation amount may be obtained using the displacement detected by the inertial feedback unit 40. The inertial force in the rotation process may be calculated with reference to the weight of the rotation component and using the acceleration, of the rotation component, detected by the inertial feedback unit 40 in the rotation process.

The auxiliary board 20 and elements (which are partial elements connected to the auxiliary board 20, of the antenna 30, the inertial feedback unit 40, and the actuator 50, and partial elements of the elastic element 60 that are connected to the auxiliary board 20) fastened to the auxiliary board 20 jointly form the rotation component. A gravity position of the rotation component overlaps the position of the rotation center, or a distance between a gravity position of the rotation component and the position of the rotation center is less than a shortest distance between the gravity position of the rotation component and an edge of the auxiliary board 20. An optimal implementation is that the gravity position overlaps the rotation center. In such setting that the gravity position is close to the rotation center or overlaps the rotation center, the inertial force of the rotation component is extremely small in the rotation process, and the output power of driving of the actuator 50 can be further reduced. In addition, space utilization is improved, thereby helping a miniaturization design of the antenna adjustment system.

Further, the rotation center is located at a central position of the auxiliary board 20. For example, if the auxiliary board 20 is a circular board, the rotation center is at a circle center of the auxiliary board 20. Certainly, the auxiliary board 20 may be in another shape, such as a square or a regular polygon.

In an implementation, the antenna 30 is fastened to one side of the auxiliary board 20, the inertial feedback unit 40 is fastened to the other side of the auxiliary board 20, and the elastic element 60 and the actuator 50 are each connected between the other side of the auxiliary board 20 and the housing 10.

In an implementation, the elastic element 60 and the actuator 50 are symmetrically distributed on the two sides of the rotation center. Due to the symmetrical distribution design, the elastic force of the elastic element 60 can be directly equal to the driving force of the actuator 50. In a process in which the controller controls the actuator 50, it is easy to calculate a current value or a voltage value required by the actuator 50 because the elastic force is equal to the driving force. The elastic force may be calculated using the deformation amount of the elastic element 60 and the elastic system. One end of the elastic element 60 is fastened to the housing 10, and the other end of the elastic element 60 is fastened to the auxiliary board 20. In a process in which the actuator 50 drives the auxiliary board 20 to rotate, the elastic element 60 is configured to provide, for the auxiliary board 20, elastic force in a same direction as the driving force of the actuator 50.

In another implementation, the elastic element 60 and the actuator 50 are distributed on a same side of the rotation center. When the actuator 50 drives the auxiliary board 20 to rotate, the elastic element 60 is configured to provide, for the auxiliary board 20 through deformation, elastic force in a direction opposite to that of the driving force of the actuator 50.

There may be a plurality of implementations for the actuator 50. For example, in an implementation, the actuator 50 is a voice coil actuator, and the actuator 50 includes a base and a mover. The base is hingedly connected to the housing 10, and the mover is hingedly connected to the auxiliary board 20. The mover is configured to apply force to the auxiliary board 20 when the housing 10 is deflected such that the auxiliary board 20 rotates around the rotation center in a direction opposite to a deflection direction of the housing 10. During operation of the actuator 50, linear rotation of the mover relative to the base is changed into rotational motion of the auxiliary board 20 relative to the housing 10. The voice coil actuator may be any one of a cylindrical voice coil actuator, an actuator that changes linear motion into rotational motion, and a circular (swing) voice coil actuator.

In another implementation, the actuator 50 is a torque motor, and the actuator 50 includes a mounting rack and a motor shaft. The mounting rack is fastened to the housing 10, and the motor shaft is fastened to the auxiliary board 20. The motor shaft is configured to apply force to the auxiliary board 20 when the housing 10 is deflected such that the auxiliary board 20 rotates around the rotation center in a direction opposite to a deflection direction of the housing 10. During operation of the actuator 50, the motor shaft drives the auxiliary board 20 to rotate relative to the housing 10.

The controller includes a first comparison unit, a second comparison unit, and a power driving unit. The first comparison unit is configured to compare a first preset value with the swing angle of the antenna 30 that is detected by the inertial feedback unit 40, and the first comparison unit sends a signal to the power driving unit when the swing angle is greater than or equal to the first preset value such that the power driving unit drives the actuator 50, and the actuator 50 drives the antenna 30 to rotate back. The inertial feedback unit 40 continues to detect a back-rotation angle of the antenna 30. The second comparison unit is configured to compare a second preset value with a difference between the swing angle and the back-rotation angle, and when the difference between the swing angle and the back-rotation angle is less than the second preset value, the second comparison unit sends a signal to the power driving unit, and the power driving unit stops driving the actuator 50.

The first preset value and the second preset value may be designed based on an antenna type or an antenna use scenario. For example, in an implementation, the first preset value ranges from 0.1 degree to 0.2 degree, and the second preset value ranges from 0.2 degree to 0.5 degree.

The elastic element 60 is a linear spring or a rotary spring.

The inertial feedback unit 40 includes a gyroscope and an accelerometer. An angular velocity at which the antenna 30 swings is collected using the gyroscope, the swing angle of the antenna 30 is collected using the accelerometer, and the angular velocity collected by the gyroscope and the angle collected by the accelerometer are mutually corrected, to ensure precision of position control for the antenna 30.

Figure 5:
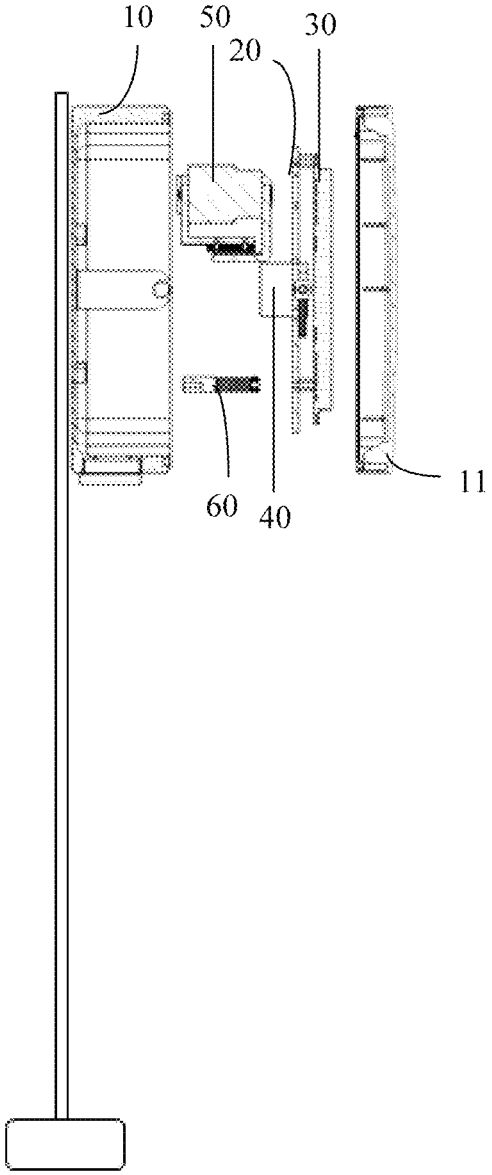
FIG. 5 is a schematic diagram of an initial position at which a base station is installed on a lamp pole according to an implementation of the present disclosure, where the base station is in an exploded state.
Figure 6:
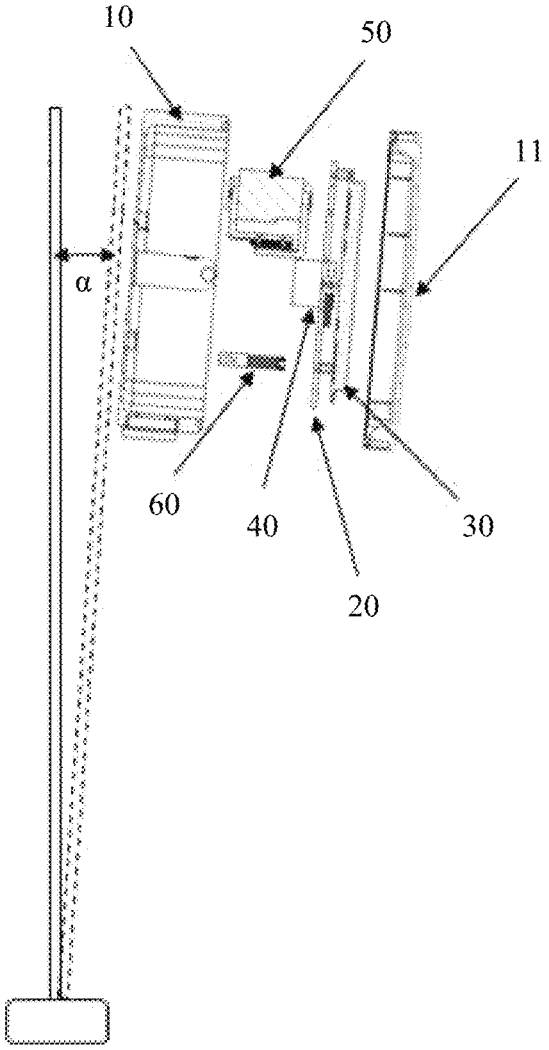
FIG. 6 is a schematic diagram of a state of the base station installed on the lamp pole shown in FIG. 5 when the lamp pole swings.
Figure 7:
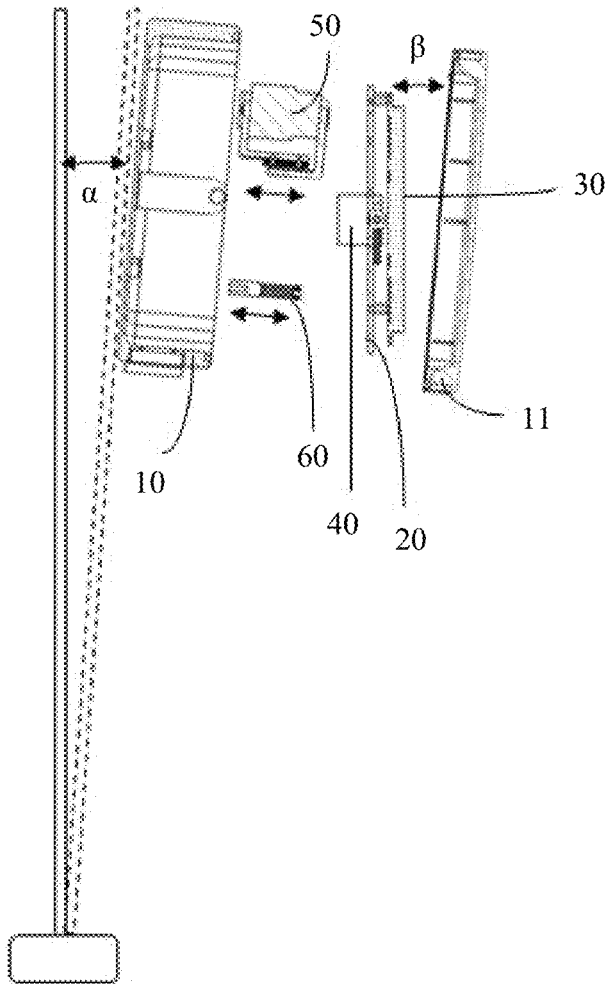
FIG. 7 is a schematic diagram of a state that is of the base station installed on the lamp pole shown in FIG. 6 and that is obtained after adjustment performed by an antenna adjustment system.

Referring to FIG. 5 to FIG. 7, the base station 100 and the antenna adjustment system provided in the present disclosure can adjust the position of the antenna 30 when the position of the antenna 30 is deflected or swings with the housing 10. FIG. 5 shows an initial installation position at which the base station 100 is installed on an upper part of a lamp pole. At the initial installation position, signal receiving and sending performance of the antenna 30 in the base station 100 is optimal. The antenna 30 in an initial installation state shown in FIG. 5 is in a vertical direction. In another implementation, an initial installation angle of the antenna is adjusted based on performance of the antenna 30. For example, in the initial installation state of the antenna, an included angle between the antenna and the vertical direction is set to 30 degrees. FIG. 6 shows swing of the base station 100 and the antenna 30 due to swing of the lamp pole. A swing angle is $\alpha$, and the antenna 30 deviates from the initial installation position. When the antenna 30 deviates from the initial installation position, the inertial feedback unit 40 detects a status of the antenna 30, and the controller drives the actuator 50 to further adjust the antenna 30 such that the antenna 30 moves relative to the housing 10, and returns to the initial installation angle. A back-rotation angle of the antenna is $\beta$, and $\alpha$-$\beta$ is smaller than a range from 0.2 degree to 0.5 degree. Referring to FIG. 7, FIG. 7 is a state of the antenna after the antenna returns to the initial installation position. Therefore, when an external environment forces the base station 100 to swing, the antenna adjustment system can adaptively adjust the position of the antenna 30 (to be specific, constantly adjust the antenna 30 in a process in which the antenna 30 swings with the housing 10 of the base station 100) in order to counteract swing of the antenna 30. Therefore, the antenna 30 transfers a signal in a stable manner, and signal interruption caused by swing of the antenna 30 is avoided.

The antenna 30 in the present disclosure may be a panel antenna, a parabolic antenna, or a circular antenna.

The foregoing descriptions are implementations of the present disclosure. It should be noted that a person of ordinary skill in the art may make several improvements and polishing without departing from the principle of the present disclosure, and the improvements and polishing shall fall within the protection scope of the present disclosure.

The invention claimed is:

1. An antenna adjustment system, comprising:

a housing;

an auxiliary board rotatably coupled to the housing, a rotation center being formed at a position at which the auxiliary board and the housing are rotatably coupled;

an antenna coupled to the auxiliary board;

an inertial feedback circuit coupled to the auxiliary board and configured to:

detect a deflection angle of the antenna when the antenna swings with the housing; and send an angle signal to a controller, the controller being coupled to the inertial feedback circuit and configured to receive and process the angle signal;

an actuator coupled to the controller; and an elastic element, the actuator and the elastic element each being coupled between the housing and the auxiliary board and configured to control the auxiliary board to rotate back in a direction opposite to a swing direction of the housing to counteract deflection caused by swing of the housing, and the controller being further configured to drive the actuator based on the angle signal.

2. The antenna adjustment system of claim 1, wherein the auxiliary board and elements coupled to the auxiliary board jointly form a rotation component, and a gravity position of the rotation component overlapping the position of the rotation center.

3. The antenna adjustment system of claim 1, wherein the auxiliary board and elements coupled to the auxiliary board jointly form a rotation component, and a distance between a gravity position of the rotation component and the position of the rotation center being less than a shortest distance between the gravity position of the rotation component and an edge of the auxiliary board.

4. The antenna adjustment system of claim 1, wherein the elastic element and the actuator are distributed on two sides of the rotation center, one end of the elastic element being coupled to the housing, the other end of the elastic element being coupled to the auxiliary board, and the elastic element being further configured to provide, for the auxiliary board, elastic force in a same direction as a driving force of the actuator in a process in which the actuator drives the auxiliary board to rotate.

5. The antenna adjustment system of claim 1, wherein the elastic element and the actuator are distributed on a same side of the rotation center, one end of the elastic element being coupled to the housing, the other end of the elastic element being coupled to the auxiliary board, and the elastic element being further configured to provide, for the auxiliary board through deformation, elastic force in a direction opposite to that of a driving force of the actuator when the actuator drives the auxiliary board to rotate.

6. The antenna adjustment system of claim 1, wherein the actuator comprises a voice coil actuator, a base and a mover, the base being hingedly coupled to the housing, and the mover being hingedly coupled to the auxiliary board and configured to apply force to the auxiliary board to enable the auxiliary board to rotate around the rotation center in a direction opposite to a deflection direction of the housing when the housing is deflected.

7. The antenna adjustment system of claim 1, wherein the actuator comprises a torque motor, a mounting rack and a motor shaft, the mounting rack being coupled to the housing, the motor shaft being coupled to the auxiliary board and configured to apply force to the auxiliary board to enable the auxiliary board to rotate around the rotation center in a direction opposite to a deflection direction of the housing when the housing is deflected.

8. The antenna adjustment system of claim 1, wherein the controller comprises a first comparison circuit configured to:

compare a first preset value with the deflection angle of the antenna detected by the inertial feedback circuit; and send a signal to a power driving circuit when the deflection angle is greater than or equal to the first preset value, the power driving circuit coupled to the first comparison circuit and configured to drive the actuator based on the received signal to enable the actuator to drive the antenna to rotate back; and a second comparison circuit coupled to the first comparison circuit and the power driving circuit, the second comparison circuit configured to:

compare a second preset value with a difference between the deflection angle and a back-rotation angle detected by the inertial feedback circuit; and send a signal to the power driving circuit when the difference between the deflection angle and the back-rotation angle is less than the second preset value, and the power driving circuit being further configured to stop driving the actuator based on the signal received from the second comparison circuit.

9. The antenna adjustment system of claim 8, wherein the second preset value ranges from 0.2 degree to 0.5 degree.

10. The antenna adjustment system of claim 8, wherein the first preset value ranges from 0.1 degree to 0.2 degree.

11. A base station, comprising an antenna adjustment system, the antenna adjustment system comprising:

a housing;

an auxiliary board rotatably coupled to the housing, a rotation center being formed at a position at which the auxiliary board and the housing are rotatably coupled;

an antenna coupled to the auxiliary board;

an inertial feedback circuit coupled to the auxiliary board and configured to:

detect a deflection angle of the antenna when the antenna swings with the housing; and send an angle signal to a controller, the controller being coupled to the inertial feedback circuit and configured to receive and process the angle signal;

an actuator coupled to the controller; and an elastic element, the actuator and the elastic element each being coupled between the housing and the auxiliary board and configured to control the auxiliary board to rotate back in a direction opposite to a swing direction of the housing in order to counteract deflection caused by swing of the housing, and the controller being further configured to drive the actuator based on the angle signal.

12. The base station of claim 11, wherein the auxiliary board and elements coupled to the auxiliary board jointly form a rotation component, and a gravity position of the rotation component overlapping the position of the rotation center.

13. The base station of claim 11, wherein the auxiliary board and elements coupled to the auxiliary board jointly form a rotation component, and a distance between a gravity position of the rotation component and the position of the rotation center being less than a shortest distance between the gravity position of the rotation component and an edge of the auxiliary board.

14. The base station of claim 11, wherein the elastic element and the actuator are distributed on two sides of the rotation center, one end of the elastic element being coupled to the housing, the other end of the elastic element being coupled to the auxiliary board, and the elastic element being further configured to provide, for the auxiliary board, elastic force in a same direction as a driving force of the actuator in a process in which the actuator drives the auxiliary board to rotate.

15. The base station of claim 11, wherein the elastic element and the actuator are distributed on a same side of the rotation center, one end of the elastic element being coupled to the housing, the other end of the elastic element being coupled to the auxiliary board, and the elastic element being further configured to provide, for the auxiliary board through deformation, elastic force in a direction opposite to that of a driving force of the actuator when the actuator drives the auxiliary board to rotate.

16. The base station of claim 11, wherein the actuator comprises a voice coil actuator, a base and a mover, the base being hingedly coupled to the housing, and the mover being hingedly coupled to the auxiliary board and configured to apply force to the auxiliary board to enable the auxiliary board to rotate around the rotation center in a direction opposite to a deflection direction of the housing when the housing is deflected.

17. The base station of claim 11, wherein the actuator comprises a torque motor, a mounting rack and a motor shaft, the mounting rack being coupled to the housing, the motor shaft being coupled to the auxiliary board, and the motor shaft being configured to apply force to the auxiliary board to enable the auxiliary board to rotate around the rotation center in a direction opposite to a deflection direction of the housing when the housing is deflected.

18. The base station of claim 11, wherein the controller comprises a first comparison circuit configured to:

compare a first preset value with the deflection angle of the antenna detected by the inertial feedback circuit; and send a signal to a power driving circuit when the deflection angle is greater than or equal to the first preset value, the power driving circuit coupled to the first comparison circuit and configured to drive the actuator based on the received signal to enable the actuator to drive the antenna to rotate back; and a second comparison circuit coupled to the first comparison circuit and the power driving circuit, the second comparison circuit configured to:

compare a second preset value with a difference between the deflection angle and a back-rotation angle detected by the inertial feedback circuit; and send a signal to the power driving circuit when the difference between the deflection angle and the back-rotation angle is less than the second preset value, and the power driving circuit being further configured to stop driving the actuator based on the signal received from the second comparison circuit.

19. The base station of claim 18, wherein the second preset value ranges from 0.2 degree to 0.5 degree.

20. The base station of claim 18, wherein the first preset value ranges from 0.1 degree to 0.2 degree.

* * * * *